United States Patent [19]

Suey

[11] Patent Number: 4,972,785

[45] Date of Patent: Nov. 27, 1990

[54] FREE HANGING REHEAT FURNACE DOOR

[76] Inventor: Paul V. Suey, R.D. #1 Ridge Rd., Natrona Heights, Pa. 15065

[21] Appl. No.: 490,894

[22] Filed: Mar. 9, 1990

[51] Int. Cl.[5] ..... F23M 7/00

[52] U.S. Cl. ..... 110/173 C; 110/173 R; 432/250

[58] Field of Search ..... 110/173 R, 173 C; 432/250; 126/190, 194; 202/242, 247, 248

[56] References Cited

U.S. PATENT DOCUMENTS 222,068 11/1879 McKelvey ..... 110/173 C
4,666,404 5/1987 Suey ..... 432/250

FOREIGN PATENT DOCUMENTS 169597 10/1921 United Kingdom ..... 110/173 C

*Primary Examiner*—Edward G. Favors
*Attorney, Agent, or Firm*—Parmelee, Miller, Welsh & Kratz

[57] ABSTRACT

A free hanging reheat furnace door has a main door section with modular refractory units secured to a frame in lateral rows and a detachable bottom door section formed from channels and struts which is also covered by modular refractory units. The door sections are detachably secured together with modular refractory units of each section mating together, and preferably a refractory shoe is provided that fits a recess in the lower modular units and encloses the lower channel of the bottom door section. Pairs of doors may be hung side-by-side with L-shaped refractory members secured to confronting sides of the doors to seal the gap between adjacent spaced doors.

9 Claims, 4 Drawing Sheets

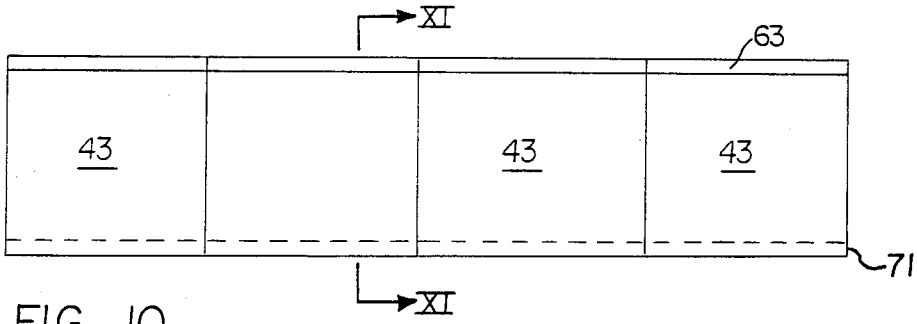
FIG. 10
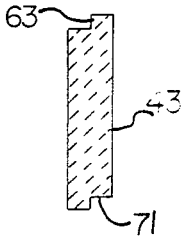
FIG. 11
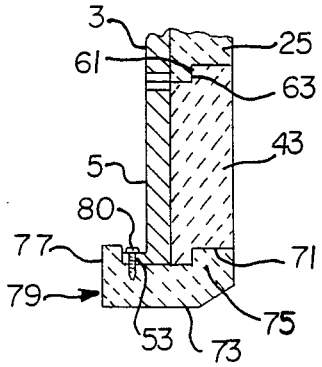
FIG. 12
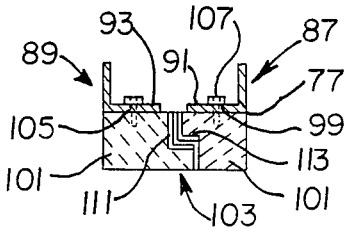
FIG. 17
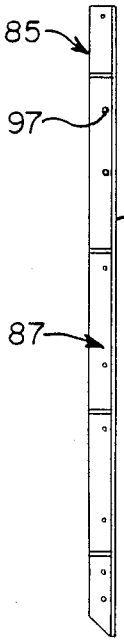
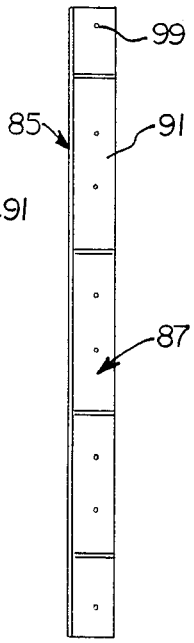
FIG. 15 FIG. 16
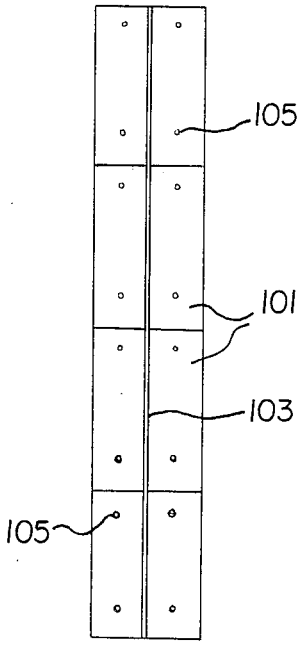
FIG. 18

FREE HANGING REHEAT FURNACE DOOR

FIELD OF THE INVENTION

The present invention relates to a reheat furnace door for use on furnaces for the reheating of slabs, billets, ingots or the like of metal, and specifically to a reheat furnace door that is hung by gravity and raised or lowered from hangers above the furnace door opening.

BACKGROUND OF THE INVENTION

In metallurgical processing, it is often necessary to reheat metal slabs, billets, ingots or the like after initial formation and prior to rolling. The furnace is used to heat the metal uniformly, and by temperature and combustion control, heat the metal in a fixed position on the furnace hearth until it is heated to rolling temperature. A refractory door or doors, depending on the furnace size, are used to retain the heat within the furnace during the reheating step. Usually, such doors hang freely suspended from a superimposed support structure that supports the door and has apparatus for raising or lowering the door as desired. Such doors can normally range in size from four to twenty-five feet in width and from three to about nine feet in height. The furnace opening that these doors cover can range from about three by three feet to twenty five by nine feet. Some furnaces use a single door to cover the furnace opening while others have two or more side-by-side doors to cover the opening.

During use, the reheat furnace door is raised during changing or removing a metal form, generally using a horizontally extending crane or boom. One area of the reheat furnace door that is constant jeopardy of severe damage is the bottom of the door. When this area is hit by the boom end or billet, during changing or removal, the refractory with which the door is lined begins to spall away and the door's life is limited, since soon the total refractory portion must be replaced so as to reduce the risk of warping or total door failure. Even though only a small portion of the refractory lining may be hit by the metal form, heat escaping through the opening formed in the refractory can cause the structural portion of the door to overheat and warp.

It is an object of the present invention to provide a reheat furnace door that, when damage to the bottom portion thereof occurs, can be refurbished without having to remove the entire door from the furnace.

SUMMARY OF THE INVENTION

A free hanging reheat furnace door has a rectangular main door section with a frame formed from top, bottom and side beams, with spaced cross beams and support beams extending between the periphery of the frame, and a plurality of lateral rows of modular refractory units secured to and closing any open areas, as well as covering the beams. A separate rectangular bottom door section is provided that is formed from upper and lower channels and struts connecting the channels and has modular refractory units secured to and closing any open areas, as well as covering the channels and struts, with the bottom door section detachably secured to the bottom beam of the main door section.

The bottommost row of modular refractory units preferably has a step into which a shoulder on the upper ends of the modular refractory units of the bottom door section mates. The modular refractory units of the bottom door section can have a recess formed in the bottom ends, with a refractory shoe provided that fits into the recess and encloses the lower channel of the bottom door section.

When a pair of doors are used to close the furnace opening, the doors are hung side-by-side with a gap therebetween and L-shaped refractory members are secured to the confronting sides of the doors, with confronting L-shaped refractory members cooperating with each other to seal the space between the two doors.

DESCRIPTION OF THE DRAWINGS

The invention will become more readily apparent from the following description of preferred embodiments thereof shown, by way of example only, in the accompanying drawings, wherein:

FIG. 10 is an elevational view of a row of modified modular refractory units used for the bottom door section for use with a refractory shoe;

FIG. 11 is an elevational cross-section showing a refractory shoe cooperating with the modular refractory units shown in FIG. 10 to enclose the bottom channel of the bottom door section;

FIG. 12 is an elevational cross-section view showing a refractory shoe cooperating with the modular refractory units shown in FIG. 10 to enclose the bottom channel of the bottom door section;

FIG. 15 is an side view of an angle iron member used to hold L-shaped refractory members to close the gap between a pair of doors;

FIG. 16 is a front view of the angle iron shown in FIG. 15;

FIG. 17 is a sectional view taken through confronting angle iron sections and L-shaped refractory members secured thereto; and FIG. 18 is an elevational view of the L-shaped refractory members.

DETAILED DESCRIPTION

Figure 1:
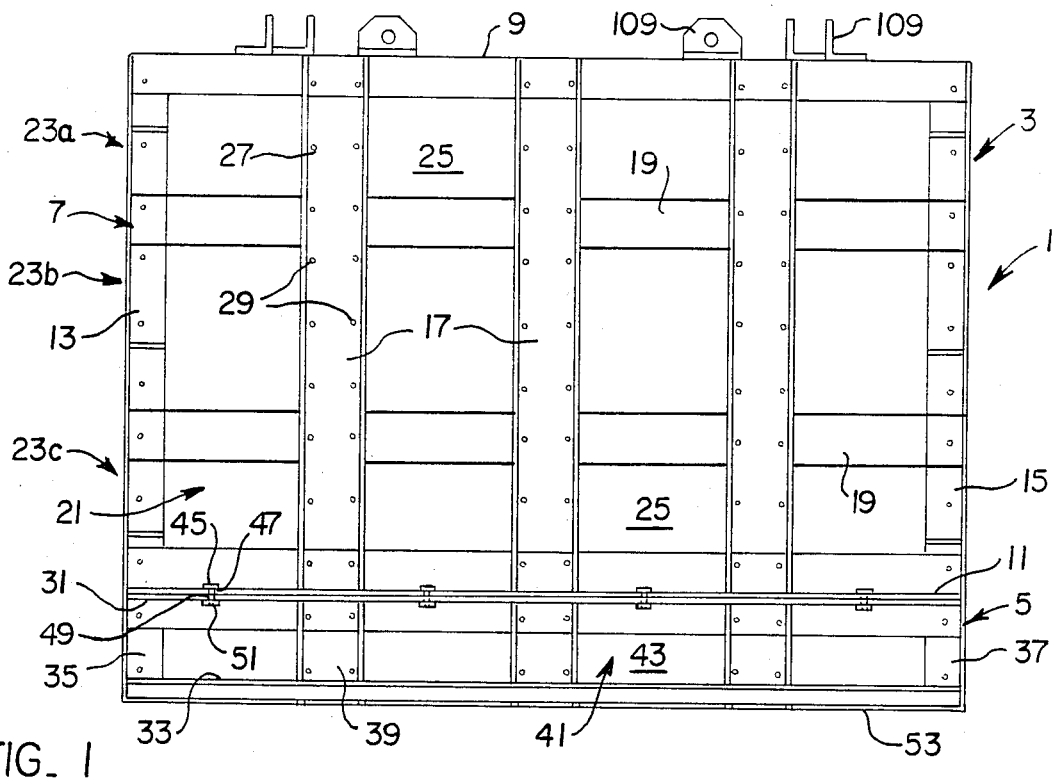
FIG. 1 is a front elevational view of the assembled reheat furnace door of the present invention.
Figure 2:
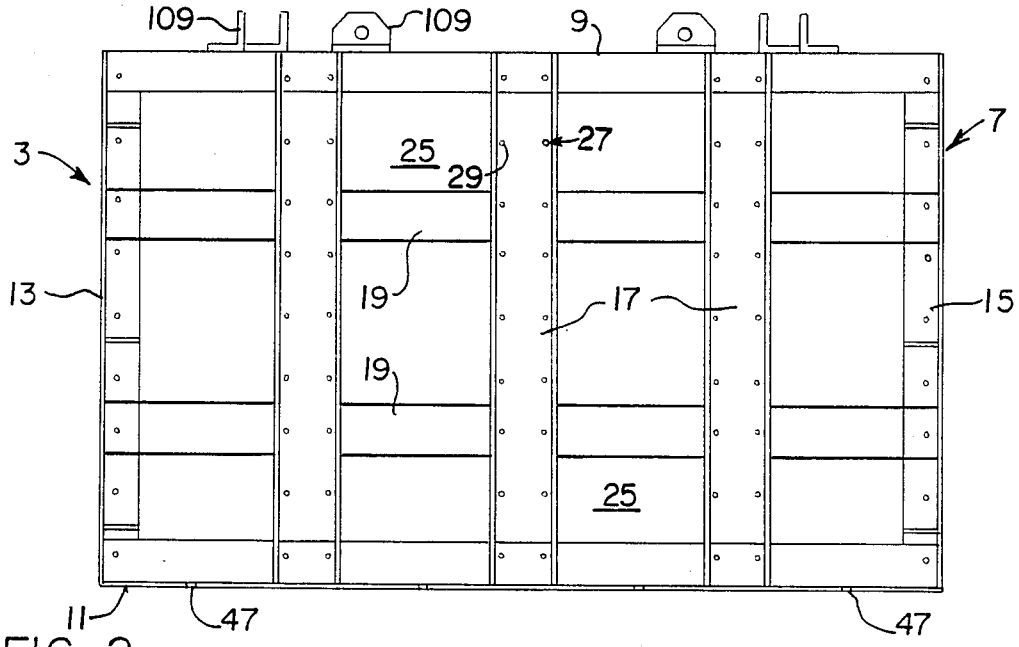
FIG. 2 is a view similar to FIG. 1, showing the main door section of the reheat furnace door from which the bottom door section has been detached.
Figure 3:
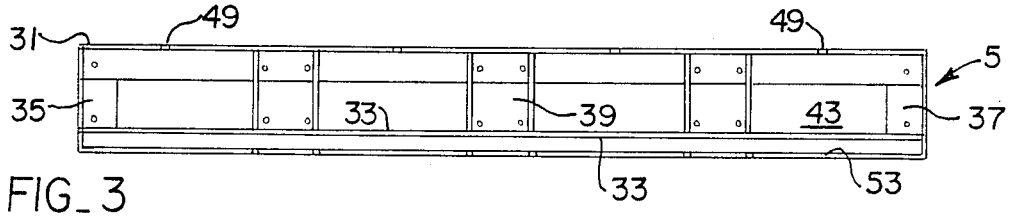
FIG. 3 is a view similar to FIG. 1 showing the bottom door section detached from the main door section.

Referring now to FIG. 1, a reheat furnace door 1 constructed according to the present invention is illustrated, the door 1 having a main door section 3 and a detachable bottom door section 5. The main door section 3 comprises a rectangular shaped frame 7 formed from a top beam 9, a bottom beam 11, and side beam 13 and 15. Extending between the top and bottom beams 9 and are a plurality of spaced cross beams 17, while spaced support beams 19 extend between adjacent cross beams 17 to form a series of open areas 21 between the cross beam 17 and support beams 19. They may be of steel and are preferably welded together. A plurality of lateral rows 23, shown as 23*a*, 23*b* and 23*c*, of modular refractory units 25 and secured to the frame 7 and cross beams 17, preferably by means of bolts 26 embedded in the modular refractory units which pass through aperture 27 and are secured thereto by nuts 29. The peripheral modular refractory units also cover the top and bottom beams and side beams as well as the cross beams and support beams to protect them from the heat of the furnace.

The detachable bottom door section 5 is formed, preferably as a rectangular section, from upper and lower spaced channel members 31 and 33 and struts that extend therebetween, including side struts 35 and 37 and spaced intermediate struts 39, the spaced top and bottom channels 31, 33 and struts 35, 37 and 39 form a series of open areas 41 which are also closed by a plurality of modular refractory units 43. The modular refractory units also cover the top and bottom channels and struts to protect them from the heat of the furnace, and are secured thereto similarly to securement of the modular refractory units 25 of the main door section 3. The channels and struts may be of steel and are preferably welded together.

The bottom door section 5 is detachably secured to the main door section 5 by a detachable securement means such as bolts 45 passing through apertures 47 in the bottom beam 11 and aperture 49 in the top channel 31 and nuts 51 threadedly engaged with the bolts 45. As illustrated, the bottom channel 33 has an outwardly extending flange 53.

Figure 4:
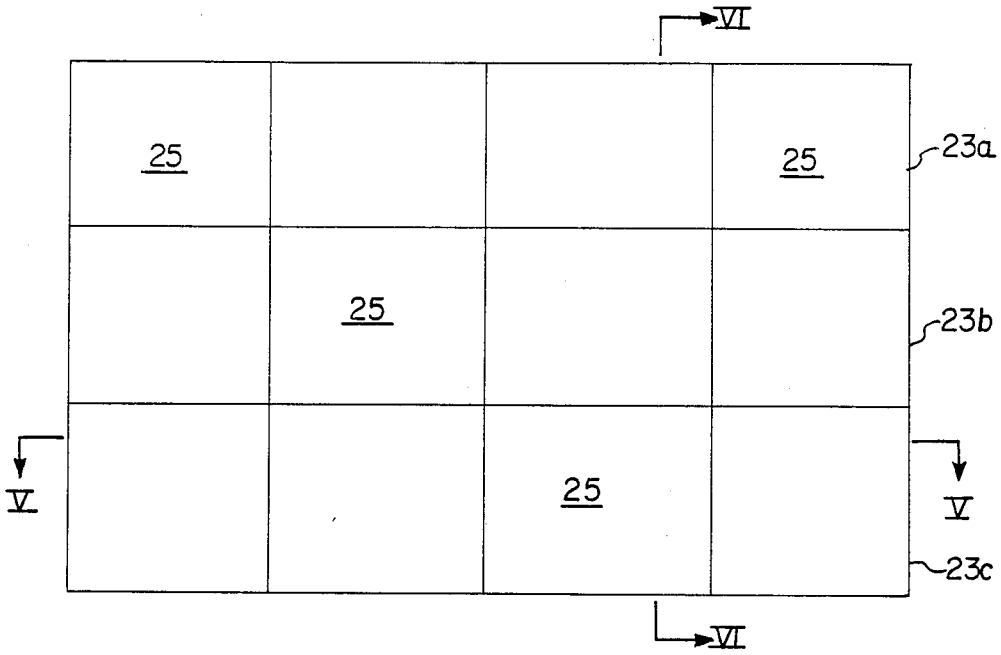
FIG. 4 is a rear view, or hot side view, of the main door section showing the secured modular refractory units.
Figure 6:
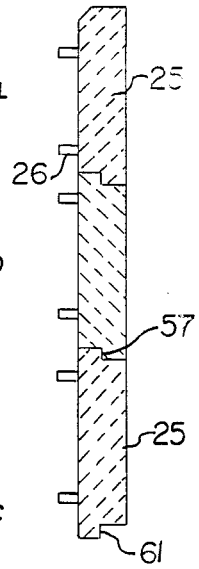
FIG. 6 is a view taken along lines VI—VI of FIG. 4.
Figure 5:
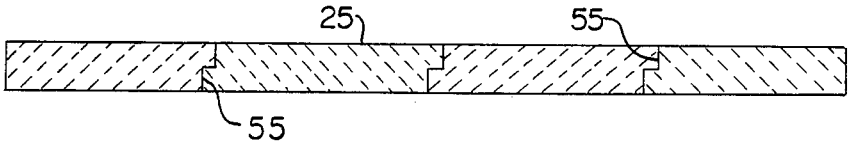
FIG. 5 is a view taken along lines V—V of FIG. 4.

The refractory side of the main door section 3, of reheat furnace door 1 is shown in FIG. 4, with the top beam 9, bottom beam 11, side beams 13 and 15, cross beams 17 and support beams 19, not visible since they are completely covered by the modular refractory units 25 and protected from the heat of the furnace. The modular refractory units 25 have horizontally overlapping portions 55 (FIG. 5) and vertically overlapping portions 57, such that no direct openings or seams are present between the modular refractory units.

Figure 7:
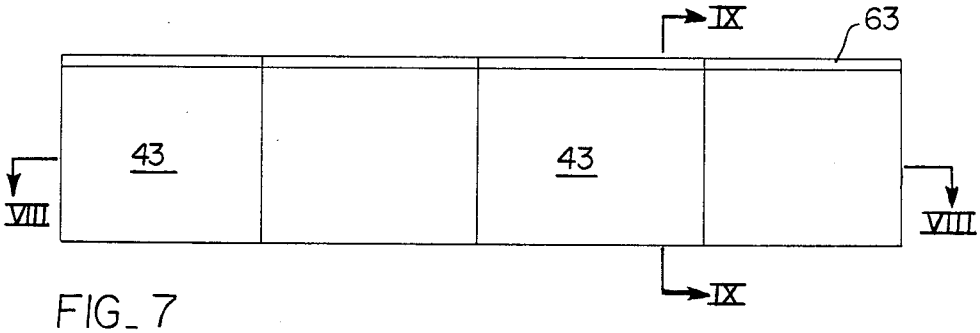
FIG. 7 is a rear view, or hot side view, of the bottom door section showing the secured modular refractory units.
Figure 9:
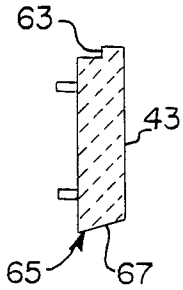
FIG. 9 is a view taken along lines IX—IX of FIG. 7.
Figure 8:
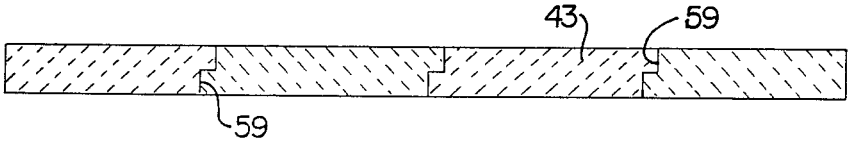
FIG. 8 is a view taken along lines VIII—VIII of FIG. 7.
Figure 13:
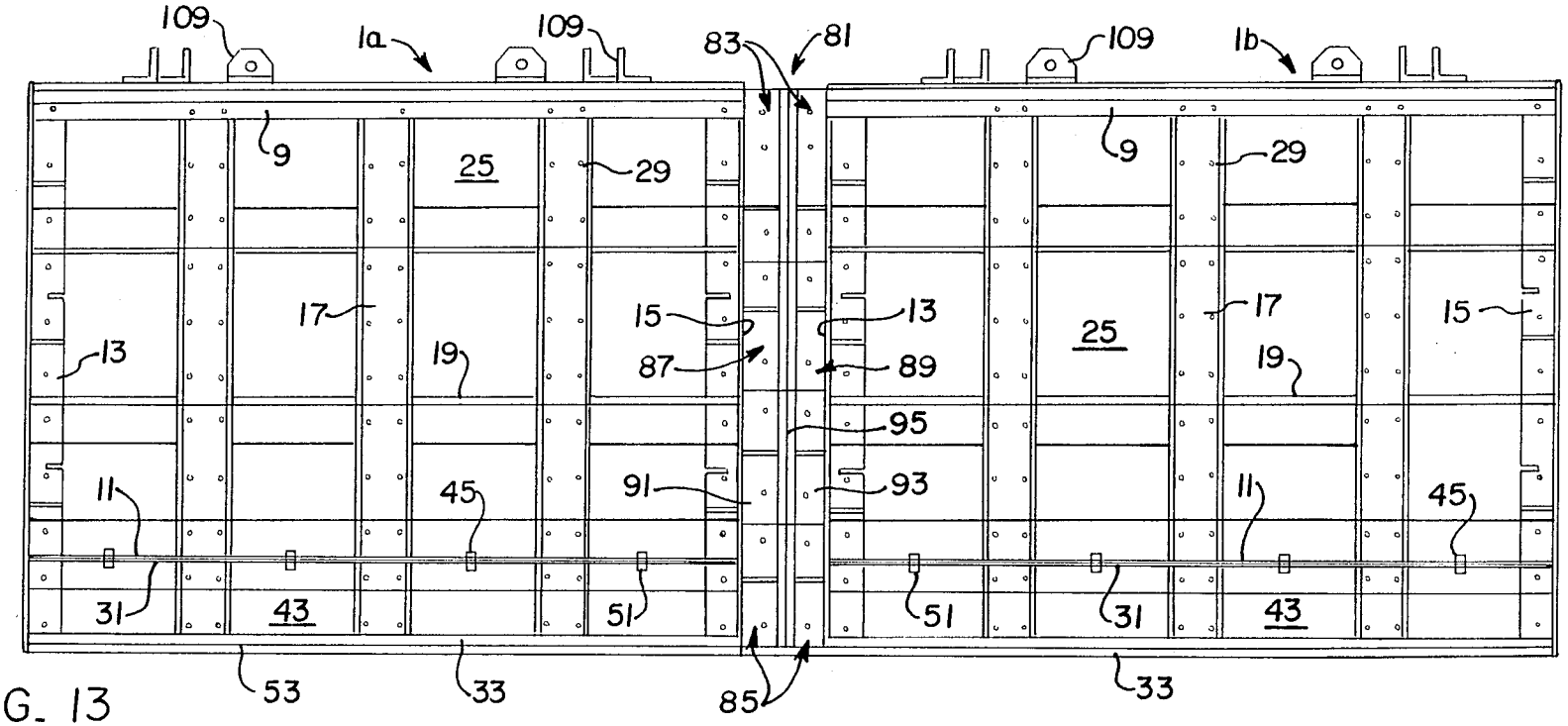
FIG. 13 is a front elevational view of an embodiment of the present invention where a pair of doors are provided to cover a reheat furnace opening.
Figure 14:
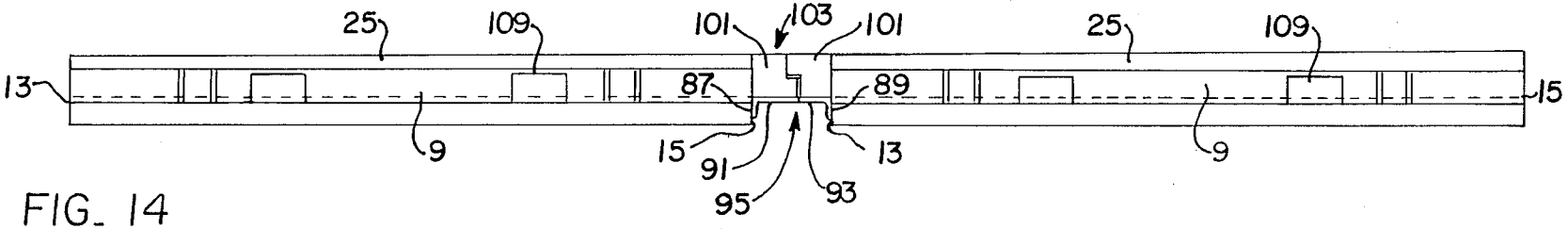
FIG. 14 is a top plan view of the pair of doors shown in FIG. 13.

The modular refractory units 43 of the detachable bottom door section 5 completely cover the upper channel member 31, lower channel member 33, side struts 35 and 37, and intermediate struts, as seen in FIG. 7. These modular refractory units 43 have horizontally overlapping portions 59 (FIG. 8) to provide a seal therebetween such that no direct openings or seams are present therebetween. In one embodiment of the present invention, the bottommost row of the lateral rows 23 of modular refractory units 25 has a step 61 therein and the upper ends of the modular units 43 have a shoulder 63 thereon which mates with the step 61.

In a preferred embodiment of the present invention, illustrated in FIGS. 10–12, the exposed ends 65 of the modular refractory units 43 of the detachable bottom door section 5, have a recess 71, and a refractory shoe 73 is provided having a tongue 75 that fits in the recess 71, the refractory shoe 73 shaped to extend outwardly beyond the outwardly extending flange 53 on the lower channel member 33 of the detachable bottom door section 5, with an upwardly extending leg 77 on the distal end 79 thereof so as to enclose the lower channel member and protect the flange 53 from the heat of the furnace when the door is both in closed or open position. The refractory shoe 73 may be secured to the flange 53 by use of an embedded bolt and nut 80, while a ceramic mortar is used to secure the tongue 75 to the modular refractory unit at recess 71.

In those cases where a single door is not suitable for use on a reheat furnace, a pair of doors may be used, as shown in the embodiment of the present invention illustrated in FIG. 13–16. As illustrated, a pair of reheat furnace doors 1, designate la (left side) and 1*b* (right side) are provided with a gap 81 between the doors, which gap 81 is closed by vertically extending sealing members 83 attached to the confronting sides of adjacent doors. The vertically extending sealing member 83 comprises vertically extending angle iron sections 85 which are secured to a confronting side wall of adjacent door, shown in FIG. 13 as angle iron section 87 secured to side beam 15 of door 1*a* and angle iron section 89 secured to confronting side beam 13 of door 1*b*. Horizontally extending portions 91 of angle iron section 87 and 93 of angle iron section 89 extend towards each other but do not touch and leave a small opening 95 therebetween.

As an example of the angle iron sections 85, a section 87 is illustrated in FIGS. 15 and 16, showing the horizontally extending section 91 thereof, this angle iron section securable to a left side hanging door 1*a*, by use of bolts passing through apertures 97 securing the angle iron section to a side beam 15, while bores 99 are formed through the horizontal section 91 for securement thereto of L-shaped refractory members. The L-shaped refractory members 101 are illustrated in FIGS. 17 and 18. FIG. 17 shows L-shaped refractory members 101 secured to horizontally extending flanges 91 and 93 of angle iron sections 87 and 89, the L-shaped sections overlapping but spaced apart a short distance, leaving a crevice 103 to permit sliding of one door relative to the other without scraping or binding of the L-shaped refractory members, while providing a tortuous rout for heat from the furnace so that no direct opening to the outside of the furnace is present. The L-shaped refractory members have embedded bolts 105 which extend through the bores 99 of the horizontally extending sections 91 and 93 and are secured thereto by nuts 107.

The reheat furnace doors 1 of the present invention are meant to be freely hung from a system for raising and lowering the doors and have lift brackets 109 attached to the tap beam 9 of the main door section 3 for attachment to a lifting device.

When adjacently spaced pairs of main door members 3 and bottom door members 5 are used, with the L-shaped refractory members 101 provided, wear plate angles 111 and 113 are set into the face of the refractory (FIG. 17) to prevent damage to the refractory members 101. The wear plate angle 111 may be formed of carbon steel since it is not directly exposed to furnace heat if the adjacent door is raised. The wear plate angle 113, however, should be formed from stainless steel, since raising of the adjacent door (carrying angle wear plate 111) will expose the wear plate angle 113 to direct heat from the furnace.

The present free hanging reheat furnace door, as described, can be refurbished, upon damage of the bottom door section, by detaching the same and attaching a new bottom door section without need to replace the whole door and without removing the whole door from the furnace.

What is claimed is:

1. A free hanging reheat furnace door comprising:

a rectangular main door section having a frame formed from top and bottom and side beams and with spaced cross beams extending between the top and bottom beams and spaced support beams extending between said cross beams, with a plurality of lateral rows of modular refractory units secured thereto and closing areas between the cross beams and support beams;

a rectangular bottom door section formed from upper and lower channel members and struts extending therebetween, having modular refractory units secured thereto and closing the areas between the channel members and struts;

the bottom door section detachably secured to the bottom cross beam of said main door section.

2. The free hanging reheat furnace door as defined in claim 1, wherein the bottommost row of the lateral rows of modular refractory units has a step therein, and the upper ends of the modular refractory units of the bottom door section have a shoulder thereon mating within the step of said bottommost row.

3. The free hanging reheat furnace door as defined in claim 2, wherein the bottom ends of the modular refractory units of the bottom door section have a recess therein, and a refractory shoe is provided, having a tongue that fits in said recess, the refractory shoe shape to extend outwardly beyond and enclose an outwardly extending flange of the lower channel member of the bottom door section.

4. The free hanging reheat furnace door as defined in claim 1, wherein a pair of adjacent said main door sections and bottom door sections are provided in side-by-side spaced adjacent relationship having confronting faces, each of said confronting faces having L-shaped refractory members, the L-shaped refractory members mating with each other to seal the space between said pair of adjacent main door sections and said pair of bottom door sections.

5. A free hanging reheat furnace door comprising:

a rectangular main door section having a frame formed from top and bottom and side beams and with spaced cross beams extending between the top and bottom beams and spaced support beams extending between said cross beams, with a plurality of lateral rows of modular refractory units secured thereto and closing areas between the cross beams and support beams, the bottommost row of the lateral rows of modular refractory units having a step therein;

a rectangular bottom door section formed from upper and lower channel members and struts extending therebetween, having modular refractory units secured thereto and closing the areas between the channel members and struts, the upper ends of the modular refractory units of the bottom door section having a shoulder thereon mating within the step of said bottommost row of modular refractory units of the main door section;

the bottom door section detachably secured to the bottom cross beam of said main door section.

6. The free hanging reheat furnace door as defined in claim 5, wherein the bottom ends of the modular refractory units of the bottom door section have a recess therein, and a refractory shoe is provided, having a tongue that fits in said recess, the refractory shoe shaped to extend outwardly beyond and enclose an outwardly extending flange of the lower channel member of the bottom door section.

7. A free hanging reheat furnace door comprising:

a pair of adjacently side-by-side, rectangular main door sections, each of which has a frame formed from top and bottom beams and side beams and spaced support beams extending between said cross beams, with a plurality of lateral rows of modular refractory units secured thereto and closing areas between the cross beams and support beams;

a pair of adjacently spaced, side-by-side, rectangular bottom door sections formed from upper and lower channel members and struts extending therebetween, having modular refractory units secured thereto and closing the areas between the channel members and struts;

one of each of said pair of bottom door sections detachably secured to the bottom cross beam of a respective main door section;

confronting faces of each main door section and bottom door section having L-shaped refractory members, the L-shaped refractory members mating with each other to seal the space between said pair of adjacent main door sections and said pair of bottom door sections.

8. The free hanging reheat furnace door as defined in claim 7, wherein the bottommost row of the lateral rows of modular refractory units has a step therein, and the upper ends of the modular refractory units of the bottom door section have a shoulder thereon mating within the step of said bottommost row.

9. The free hanging reheat furnace door as defined in claim 8, wherein the bottom ends of the modular refractory units of the bottom door section have a recess therein, and a refractory shoe is provided, having a tongue that fits in said recess, the refractory shoe shaped to extend outwardly beyond and enclose and outwardly extending flange of the lower channel member of the bottom door section.

* * * * *